United States Patent [19]

Muraji

[11] Patent Number: 5,031,596

[45] Date of Patent: Jul. 16, 1991

[54] FUEL SUPPLY SYSTEM FOR INJECTION CARBURETORS

[75] Inventor: Tetsuo Muraji, Odawara, Japan

[73] Assignee: Mikuni Kogyo Kabushiki Kaisha, Tokyo, Japan

[21] Appl. No.: 425,015

[22] Filed: Oct. 23, 1989

[51] Int. Cl.[5] ..... F02M 41/00

[52] U.S. Cl. ..... 123/463; 123/452

[58] Field of Search ..... 123/463, 452, 453, 454, 123/455

[56] References Cited

U.S. PATENT DOCUMENTS

| | | | |
|---|---|---|---|
| Re. 25,492 | 12/1967 | Dolza | 123/463 |
| Re. 25,672 | 10/1964 | Armstrong | 123/463 |
| 1,955,037 | 4/1934 | Viez | 123/463 |
| 2,374,844 | 5/1945 | Stoles | 123/463 |
| 2,378,036 | 6/1945 | Reggio | 123/403 |
| 2,447,266 | 8/1948 | Beardsley | 123/463 |
| 2,957,467 | 10/1960 | Ball | 123/463 |
| 4,228,777 | 10/1980 | Haase | 123/463 |
| 4,539,960 | 9/1985 | Cowles | 123/463 |
| 4,625,696 | 12/1986 | Radaelli | 123/463 |

*Primary Examiner*—Carl Stuart Miller

*Attorney, Agent, or Firm*—Lalos & Keegan

[57] ABSTRACT

A fuel supply system for injection carburetors includes an orifice, a constant flow rate control device, and a fuel supply source and is provided with a first fuel channel circulating fuel of a predetermined flow rate, a second fuel channel branching off from the first fuel channel between the orifice and the constant flow rate control device for injecting the fuel into a suction tube of the carburetor, an air flow rate detecting device capable of detecting a flow rate of air flowing through the suction tube, and a fuel ejection control device capable of metering the flow rate of fuel to be ejected so that a pressure difference with atmospheric pressure which is detected by the air flow rate detecting device is balanced with a fuel pressure difference between the upstream side and the downstream side of the orifice. The fuel supply system is simple in structure and can hold an air-fuel ratio of a gas mixture with a high degree of accuracy to a desired constant value, over the entire operation region, through a single fuel control unit.

6 Claims, 9 Drawing Sheets

FUEL SUPPLY SYSTEM FOR INJECTION CARBURETORS

BACKGROUND OF THE INVENTION (a) Field of the invention:

The present invention relates to an injection carburetor for internal combustion engines, and more particularly to a fuel supply system provided in a suction tube which can meter a flow rate of fuel to render an airfuel ratio of a gas mixture constant by balancing a difference between the negative pressure produced in the suction tube and the atmospheric pressure with a difference in fuel pressure between the upstream side and the downstream side of an orifice provided in a fuel passage.

(b) Description of the prior art:

In the past, a system metering a flow rate of fuel in accordance with relationship between the flow rate of fuel passing through an orifice and a difference in fuel pressure between the upstream side and the downstream side of the orifice, as in fuel injection systems of stationary venturi type carburetors and U.S. patent application Ser. No. 341,827, has been designed so that only the fuel supplied to an engine passes through the orifice. When the passed fuel is metered by the orifice, as diagrammed in FIG. 1, the fuel pressure difference is proportional to the square of the fuel flow rate, with the result that, for example, if the fuel of the amount six times the minimum supply fuel low rate of the system flows through the orifice, the fuel pressure difference will be increased as much as 36 times the difference at that time and reach a limit value in practical use. However, general engines for automobiles, which need to be capable of metering the fuel supply flow rate from the minimum to about 40 times that, cannot make use of such a conventional fuel injection system as in the foregoing. Accordingly, in order to solve this problem, as in U.S. patent application Ser. No. 352,299, a system has been proposed in the past which is constructed to arrange at least two fuel control units for a slow zone and a main zone. This system, however, has defects that its structure is complicated and the transition from the slow zone to the main zone is not performed smoothly. Further, although another system is available which is capable of covering such a wide metering range as is mentioned above in the fuel supply system with a single fuel control unit, like SU carburetors, this system brings about defects that since the arrangement is such that the fuel flow rate is metered by change of the sectional area of the fuel passage (i.e., change of channel resistance) according to the flow rate of air, metering accuracy is reduced.

SUMMARY OF THE INVENTION

A primary object of the present invention is to provide a fuel supply system for injection carburetors capable of metering accurately a flow rate of fuel covering a wide range in a single fuel control unit.

Another object of the present invention is to provide an injection carburetor which is simple in structure and suitable to common engines for automobiles.

These objects are achieved, according to the present invention, by the arrangement including a first channel for returning only fuel of a predetermined flow rate from the fuel fed from a fuel supply source, to the fuel supply source through an orifice and a constant flow rate control means; a second channel branching off from the first channel between the orifice and the constant flow rate control means for injecting the fuel into a suction tube of the carburetor; an air flow rate detecting means detecting the flow rate of air flowing through the suction tube; and a fuel ejection control means calculating the flow rate of fuel to be ejected so that a difference between the negative pressure in the suction tube and the atmospheric pressure which is detected by the air flow rate detecting means is counterbalanced with a difference in fuel pressure between the upstream side and the downstream side of the orifice to maintain consistently an air-fuel ratio of a gas mixture.

Further, according to the present invention, these objects are also accomplished by the arrangement including a first channel for feeding fuel of a predetermined flow rate from a fuel supply source through a constant flow rate control means to return part of the fuel to the fuel supply source through an orifice; a second channel branching off from the first channel between the constant flow rate control means and the orifice for injecting the fuel into a suction tube of the carburetor; an air flow rate detecting means detecting the flow rate of air flowing through the suction tube; and a fuel ejection control means calculating the flow rate of fuel to be ejected so that a difference between the negative pressure in the suction tube and the atmospheric pressure which is detected by the air flow rate detecting means is counterbalanced with a difference in fuel pressure between the upstream side and the downstream side of the orifice to maintain consistently an air-fuel ratio of a gas mixture.

According to the present invention, the constant flow rate supply means is provided with a diaphragm constituting a partition between a fuel inlet chamber and a fuel outlet chamber; a valve connected with the diaphragm to be capable of opening and closing an inlet port of the fuel inlet chamber; an orifice communicating the fuel inlet chamber with the fuel outlet chamber; and a spring pressing the diaphragm in a direction to open the valve. Also, the air flow rate detecting means is provided with a piston valve advancing into or retracting from the suction tube in accordance with the flow rate of air sucked into the suction tube; a spring pressing the piston valve in an advancing direction thereof; a negative pressure passage opened in an internal wall of the suction tube which faces to an end face of the piston valve; and an air passage opened in an air horn.

According to the fuel supply system of the present invention, since the arrangement is made so that the fuel of the predetermined flow rate is returned to the fuel supply source through the orifice apart form the flow rate of fuel metered and ejected in accordance with the flow rate of air sucked into the suction tube, the relationship between the flow rate of the ejected fuel and the fuel pressure difference assumes virtually linear form, the measuring of the fuel flow rate with a high degree of accuracy can be materialized over a wide rage even in a single fuel control unit, and the transition from the slow zone to the main zone is very smoothly made.

These and other objects as well as the features and the advantages of the present invention will become apparent from the following detailed description of the preferred embodiments when taken in conjunction with the accompanying drawings.

DESCRIPTION OF THE PREFERRED EMBODIMENTS

Figure 1:
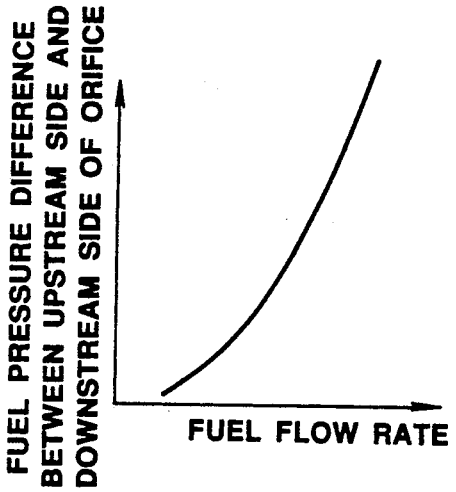
FIG. 1 is a characteristic diagram showing the relationship between a fuel flow rate and a fuel pressure difference in a conventional fuel supply system.
Figure 2:
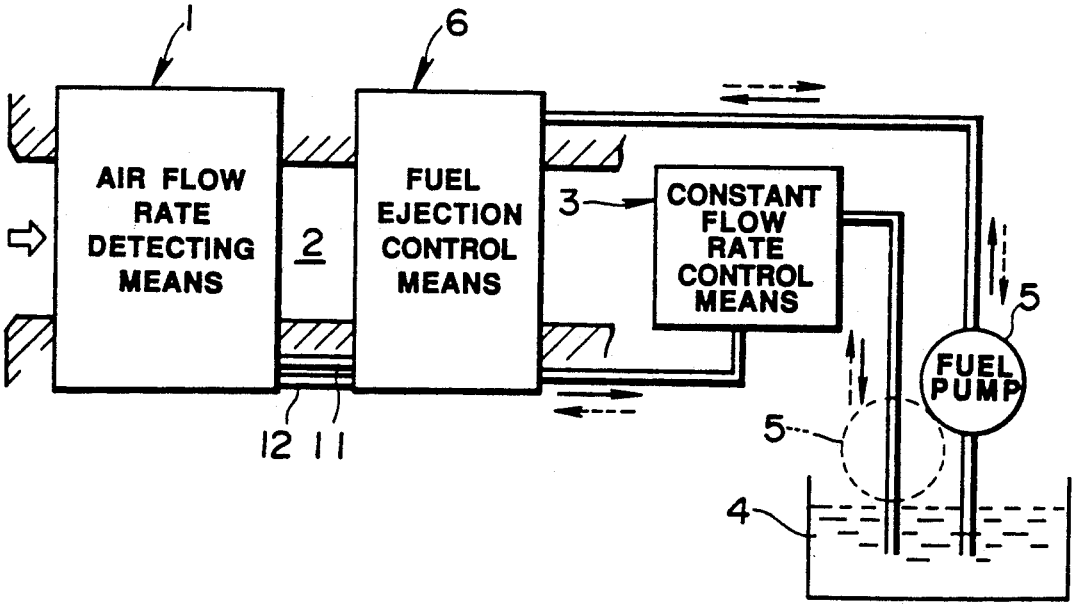
FIG. 2 is a schematic view showing a general arrangement of a fuel supply system according to the present invention.
Figure 3A:
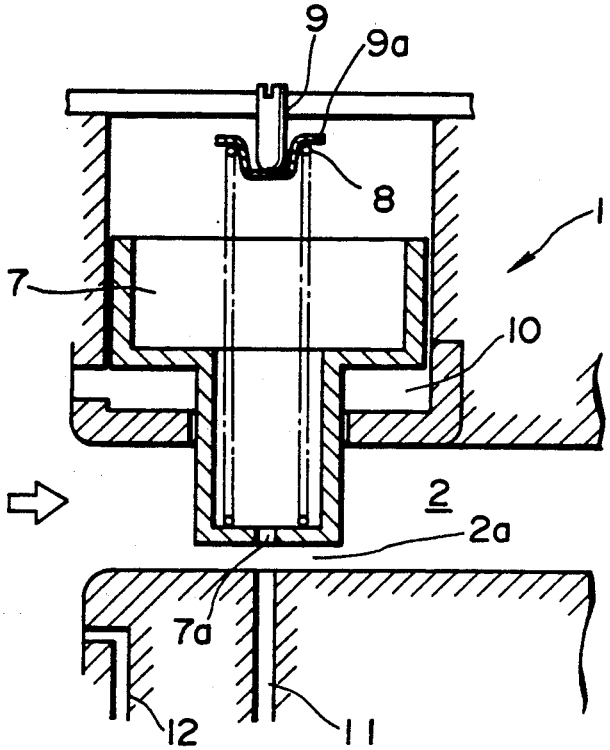
FIG. 3A is a sectional view showing concrete structure of an air flow rate detecting means.
Figure 3B:
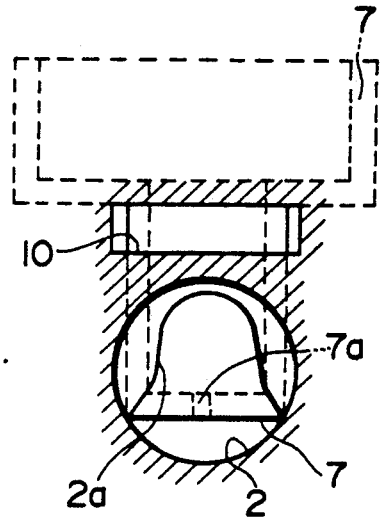
FIG. 3B is a schematic view of an end face of the air flow rate detecting means viewed in the direction of an arrow of FIG. 3A.
Figure 4:
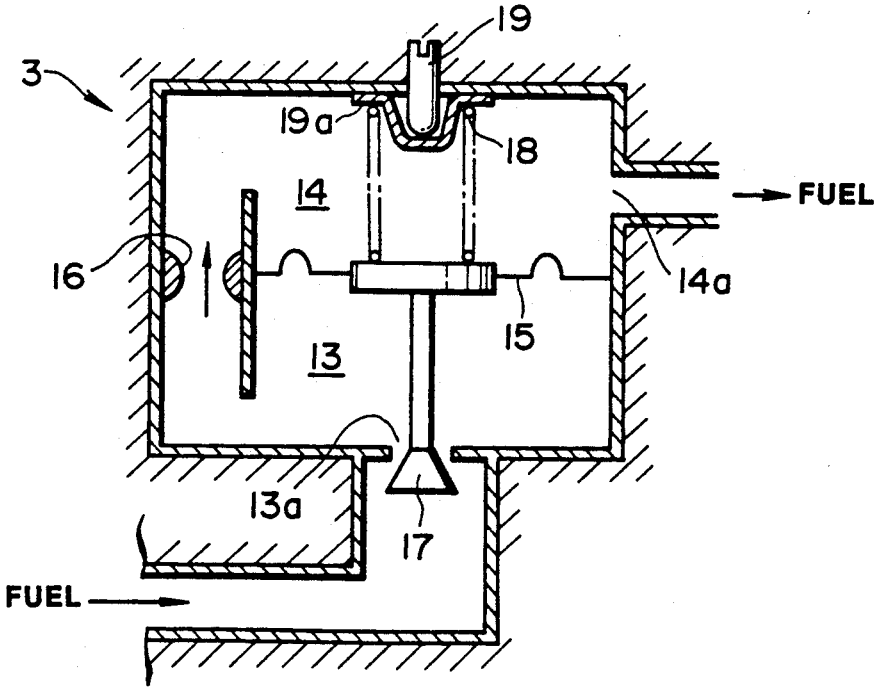
FIG. 4 is a sectional view showing concrete structure of a constant flow rate control means.
Figure 5:
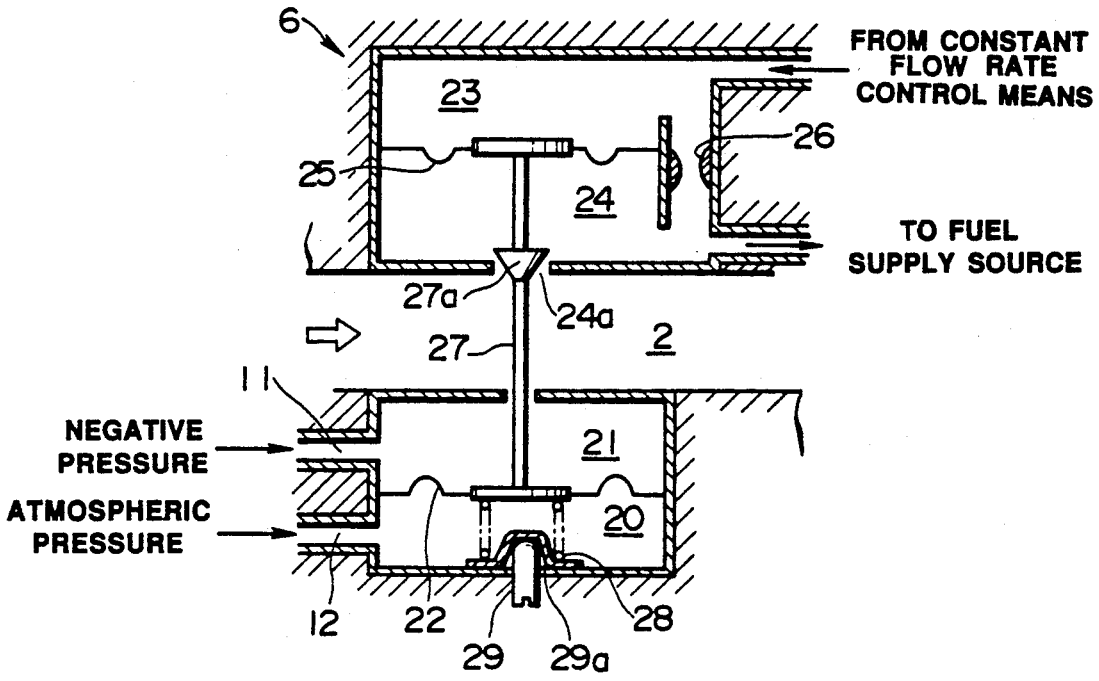
FIG. 5 is a sectional view showing concrete structure of a fuel ejection control means used in a first embodiment of the present invention.
Figure 6:
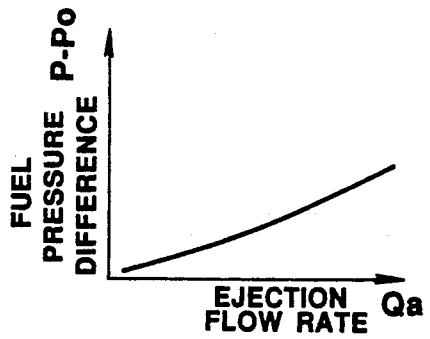
FIG. 6 is a characteristic diagram showing the relationship between a fuel ejection flow rate and a fuel pressure difference in the first embodiment.
Figure 7A:
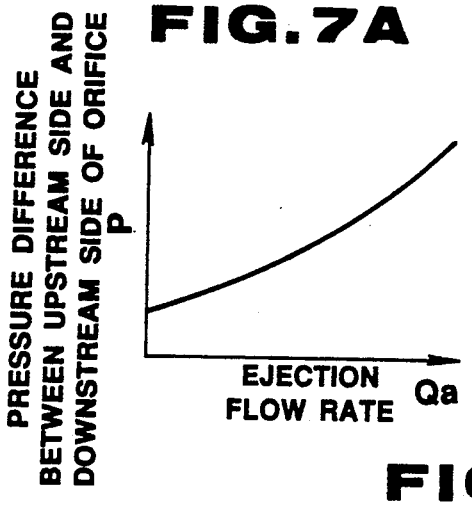
FIG. 7A is a characteristic diagram showing the relationship between a pressure difference between the upstream side and the downstream side of an orifice and a fuel ejection flow rate in the first embodiment.
Figure 7B:
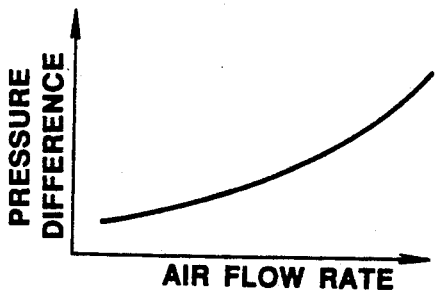
FIG. 7B is a characteristic diagram showing the relationship required between an air flow rate and a pressure difference in the first embodiment.

First of all, referring to FIGS. 2 to 5, a first embodiment of the present invention will be described below. FIG. 2 shows an example of conceptional structure of a fuel supply system according to the present invention. In this figure, reference numeral 1 represents an air flow rate detecting means detecting a flow rate of air sucked into a suction tube 2, 3 a constant flow rate control means adapted to return only fuel of a constant flow rate, from the fuel fed from a fuel supply source 4 through a fuel pump 5 to a fuel ejection control means which will be mentioned later, to the fuel supply source 4, and 6 a fuel ejection control means injecting the fuel of the amount corresponding to the air flow rate detected by the air flow rate detecting means and discharging the remainder of the fuel fed from the fuel supply source 4 into the constant flow rate control means 3. FIG. 3A depicts an example of concrete structure of the air flow rate detecting means 1. In the figure, reference numeral 7 designates a piston valve having a through-hold 7*a* in its top face for sliding in a direction normal to the suction tube 2 to form a variable venturi section 2*a* in the suction tube 2, 8 a spring biasing the piston valve 7 in a direction to narrow the variable venturi section 2*a*, 9 an adjusting screw capable of adjusting the resilient force of the spring 8 through a receiver 9*a*, 10 an atmospheric chamber provided under a large diameter section of the piston valve 7 so that atmosphere of an air horn is conducted thereinto, 11 a negative pressure passage opened in the variable venturi section 2*a* for taking out negative pressure created in the venturi section 2*a*, and 12 an air passage opened in the air horn for taking out relatively high reference pressure (for instance, atmospheric pressure). FIG. 4 shows concrete structure of the constant flow rate control means 3, in which reference numeral 13 represents an inlet chamber having a fuel inlet port 13*a*, 14 an outlet chamber separated form the inlet chamber 13 by a diaphragm 15, having a fuel outlet port 14*a*, 16 an orifice communicating the inlet chamber 13 with the outlet chamber 14, 17 a valve having an end portion connected to the diaphragm 15 to be capable of controlling an opening degree of the fuel inlet port 13*a* of the inlet chamber 13, 18 a spring urging the diaphragm 15 toward the inlet chamber 13, and 19 an adjusting screw capable of adjusting the resilient force of the spring 18 through a receiver 19*a*. FIG. 5 shows concrete structure of the fuel ejection control means used in the first embodiment of the present invention, in which reference numeral 20 represents an atmosphere chamber adapted to conduct the atmospheric pressure thereinto through the air passage 12 of the air flow rate detecting means, 21 a depression chamber adapted to conduct the negative pressure of the venturi section 2*a* thereinto through the negative pressure passage 11 of the air flow rate detecting means 1, 22 a diaphragm constituting a partition between the atmosphere chamber 20 and the depression chamber 21, 23 a fuel pressure chamber adapted to feed the fuel from the fuel supply source thereinto, 24 a fuel ejection chamber divided form the fuel pressure chamber 23 by a fuel diaphragm 25, having a fuel ejection port 24*a* open to the suction tube 2, and 26 an orifice communicating the fuel pressure chamber 23 with the fuel ejection chamber 24. Reference numeral 27 designates a connecting member connected between the diaphragms 22 and 25, having a fuel ejection valve 27*a* capable of opening and closing the fuel ejection port 24*a*, 28 a spring pressing the negative pressure diaphragm 22 to open the fuel ejection valve 27*a*, and 29 an adjusting screw adjusting the resilient force of the spring 28 through a receiver 29*a*. In the air flow rate detecting means 1 described above, the venturi section 2*a* is configured as depicted in FIG. 3B so that the difference of the pressure (the magnitude of the negative pressure) produced between the negative pressure passage 11 and the air passage 12 in accordance with the air flow rate can accommodate the relationship of the fuel flow rate and the fuel pressure difference between the upstream side and the downstream side of the orifice through which the fuel passes. Also, the constant flow rate control means 3 is constructed so that the opening degree of the valve 17 is adjusted by operating the adjusting screw 19 and thereby the flow rate of the fuel flowing through the fuel inlet chamber 13 and the fuel outlet chamber 14 is controlled. Further, in the fuel ejection control means 6, the flow rate of the fuel passing through the orifice 26 in the injection of the fuel is such that a variable ejection flow rate Qa of the fuel delivered form the ejection port 24a which is metered in response to the air flow rate is added to a predetermined flow rate $Q_A$ of the fuel returned to the fuel supply source through the constant flow rate control means 3. Now, when the fuel pressure difference between the upstream side and the downstream side of the orifice 26 is taken as P and that in the case where the ejection flow rate Qa=0 in particular is $P_0$, the relationship between the ejection flow rate Qa and the fuel pressure difference $(P-P_0)$, although dependent on the setting value of the predetermined flow rate $Q_A$, will exhibit a characteristic curve, near a straight line, deflected slightly downward as shown in FIG. 6. Further, when the effective area of each of the diaphragms 22, 25 is taken as S, the resilient force of the spring 28 as Fs, and the differential pressure detected by the air flow rate detecting means 1 as Fa, a mutual relationship is given by $$P\times S+Fa\times S+Fs=0 \quad (1)$$

and the function of the fuel ejection control means 6 is that the pressure differences are counterbalanced with each other as shown in this equation, resulting in the delivery of the fuel of the flow rate (ejection flow rate) according to the air flow rate. Also, FIG. 7A is a characteristic diagram showing the relationship of the fuel pressure difference P between the outstream side and the downstream side of the orifice 26 and the ejection flow rate Qa, and FIG. 7B the relationship of the air flow rate required accordingly for the air flow rate detecting means 1 and the pressure difference.

Next, the functions of the fuel supply system which has been mentioned will be explained below.

In this system, prior to an engine start, the fuel pump 5 is first started by an initial operation of a start key and the fuel is fed form the fuel supply source 4 to the fuel ejection control means 6 (refer to arrows of solid lines in FIG. 2). At this step that the engine is not started, since the pressure difference is not detected by the air flow rate detecting means 1, the fuel ejection valve 27a is in a closed state, and the fuel introduced into the fuel pressure chamber 23 flows into the fuel ejection chamber 24 at the predetermined flow rate $Q_A$ under the differential pressure $P_0$ and is returned to the fuel supply source 4 through the constant flow rate control means 3. That is, in the state that the engine is not yet started, the fuel of a constant flow rate is circulated by the fuel pump 5 within a closed channel constructed form the fuel supply source 4, the fuel ejection control means 6, and the constant flow rate control means. Next, when the engine is started by a further operation of the engine key, negative pressure corresponding to the flow rate of air sucked into the venturi section 2a of the suction tube 2 is produced. The negative pressure is introduced into the depression chamber 21 of the fuel ejection control means 6 through the negative pressure passage 11 and consequently the negative pressure diaphragm 22 will be displaced toward the depression chamber 21 in virtue of the pressure difference generated between the atmosphere chamber 20 and the depression chamber 21. Accordingly, the fuel ejection valve 27a is opened so that the fuel is injected into the suction tube 2 from the fuel ejection chamber 24. At the same time, the fuel pressure difference P between the upstream side and the downstream side of the orifice becomes greater than the differential pressure $P_0$ and the fuel of the flow rate Qa higher than the predetermined flow rate $Q_A$ is metered by the orifice 26 to be included in the fuel ejection chamber 24. Thus, the state that the differential pressure between the negative pressure according to the flow rate of air sucked into the suction passage 2 and the atmospheric pressure is balanced with the fuel pressure difference $(P-P_0)$ between the upstream side and the downstream side of the orifice 26 renders an air-fuel ratio of a gas mixture constant, and the fuel pressure difference $(P-P_0)$ and the flow rate Qa of the fuel to be ejected maintain the relationship such as is shown by a characteristic curve of FIG. 6, with the result that fuel flow rate control with a considerable degree of accuracy can be secured over a wide operation range.

Figure 8:
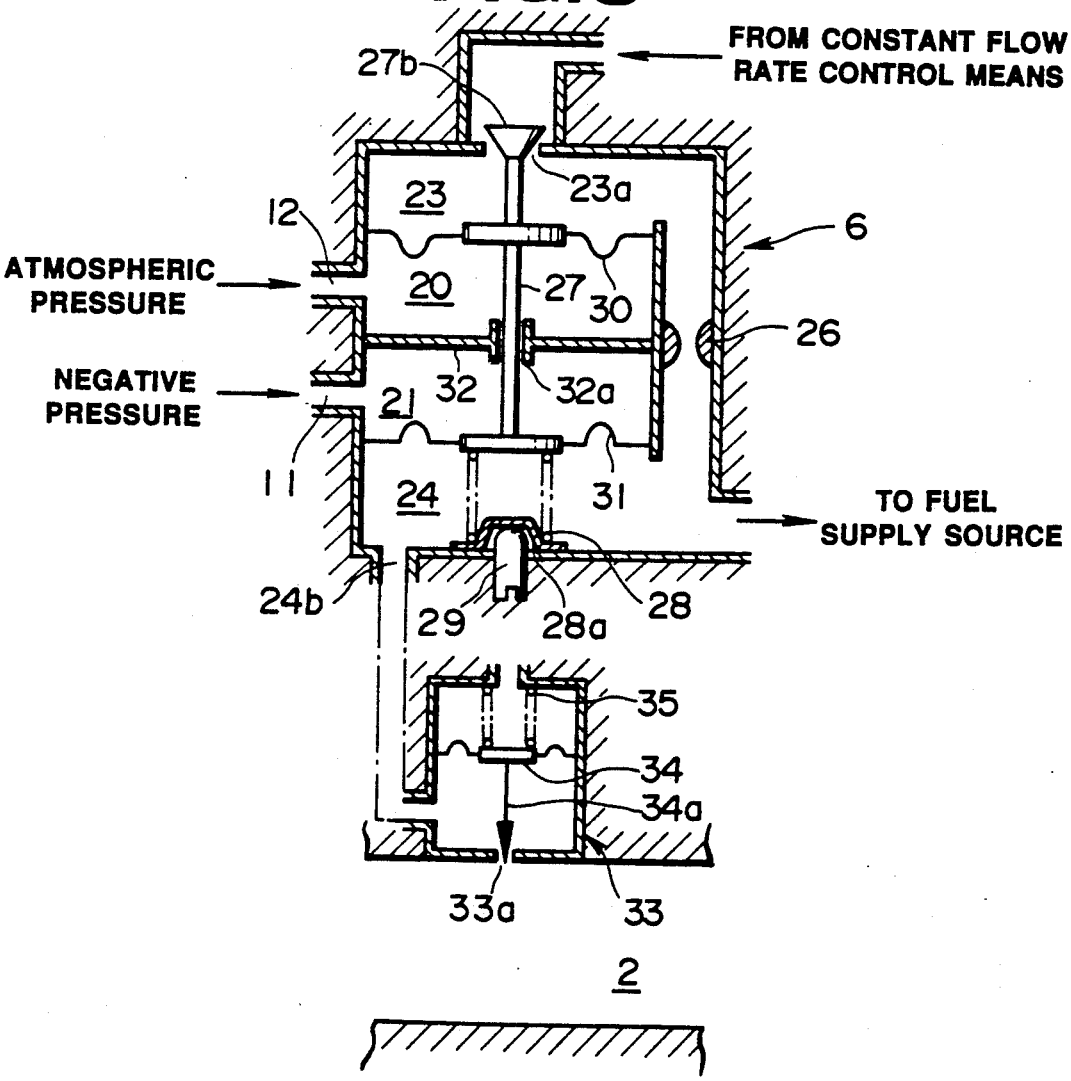
FIGS. 8 and 9 are sectional views showing concrete structure of the fuel ejection control means used in second and third embodiments, respectively.

FIG. 8 shows concrete structure of the fuel ejection control means used in a second embodiment of the present invention. In this figure, reference numeral 30 represents a first diaphragm constituting a partition between the fuel pressure chamber 23 and the atmosphere chamber 20, 31 a second diaphragm constituting a partition between the fuel ejection chamber 24 and the depression chamber 21, and 32 a partition wall dividing the atmosphere chamber 20 from the depression chamber 21 and having a small hole 32a into which the connecting member 27 is inserted. In such structure, a flow control valve 27b is configured at the upper end of the connecting rod 27, associated with a fuel inlet port 23a of the fuel pressure chamber 23, and actuated by the second diaphragm 31 displaced in response to the negative pressure of the venturi section 2a which is introduced into the depression chamber 21 to control the flow rate of the fuel introduced into the fuel pressure chamber 23. Even in the case where the negative pressure is not conducted into the depression chamber 21, however, the valve 27b is held to a predetermined opening degree by the spring 28 and the like to secure the predetermined flow rate $Q_A$. Reference numeral 33 denotes an injection nozzle ejecting the fuel, through an ejection port 33a, supplied from a discharge port 24b of the fuel ejection chamber 24 and incorporating a diaphragm 34 connected with a needle valve 34a and a spring 35. Accordingly, when the negative pressure detected by the air flow rate detecting means 1 is conducted into the depression chamber 21, the valve 27a is moved in its opening direction and resultant increase of the amount of a fuel flow from the fuel supply source 4 causes the fuel pressure in each of the chambers 23, 24 to be raised, so that force acting upward on the diaphragm 34 of the injection nozzle 33 is increased to open the valve 34a against the resilient force of the spring 35, thereby injecting the fuel into the suction tube 2. Thus, the fuel pressure difference between the upstream side and the downstream side of the orifice 26 is increased so that the negative pressure accommodating the flow rate of air flowing through the suction tube 2 is balanced with the fuel pressure difference.

Figure 9:
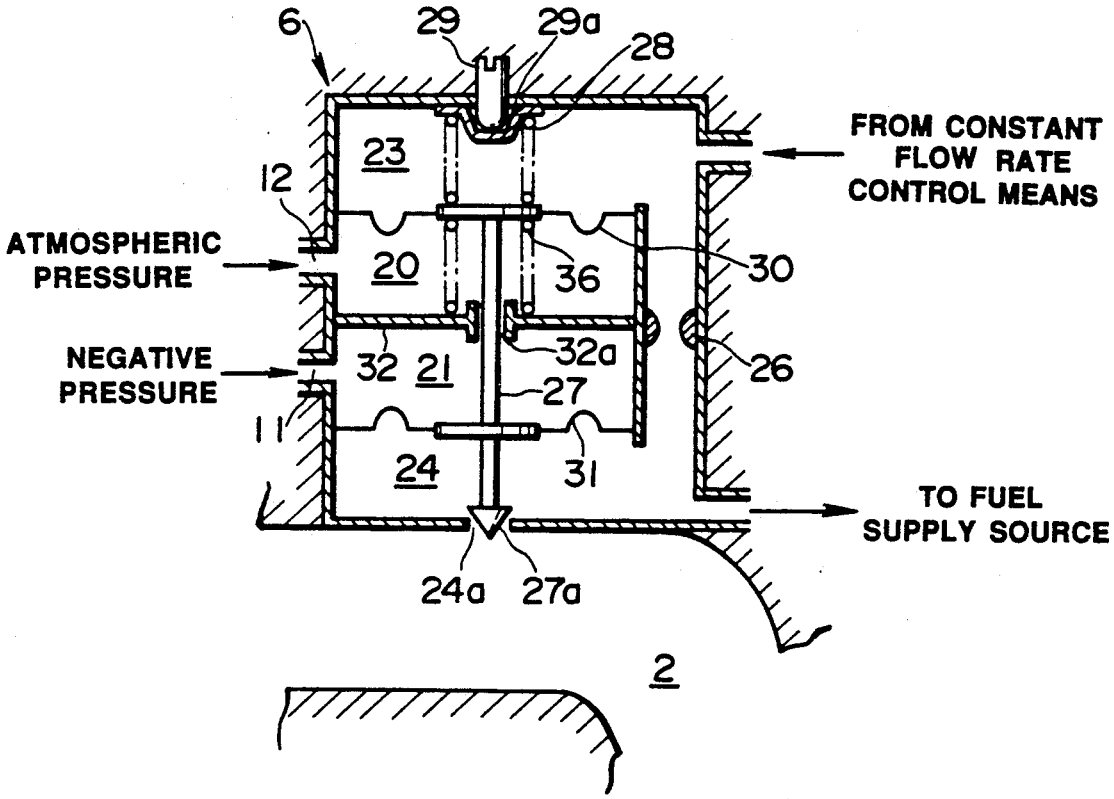

FIG. 9 shows concrete structure of the fuel ejection control means used in a third embodiment of the present invention. This embodiment is such that the fuel ejection valve 27a is configured at the lower end of the connecting member 27 to open and close the ejection port 24a of the fuel ejection chamber 24. Specifically, the fuel ejection valve 27a is actuated by the displacement of the second diaphragm 31 according to the negative pressure conducted into the depression chamber 21 for control of the amount of fuel injection. Reference numeral 36 denotes a spring arranged opposite to the spring 28 across the first diaphragm 30 to urge the valve 27*a* in its opening direction and the difference of the resilient force between the springs 28 and 36 corresponds to Fs of the equation (1) mentioned above.

Figure 10:
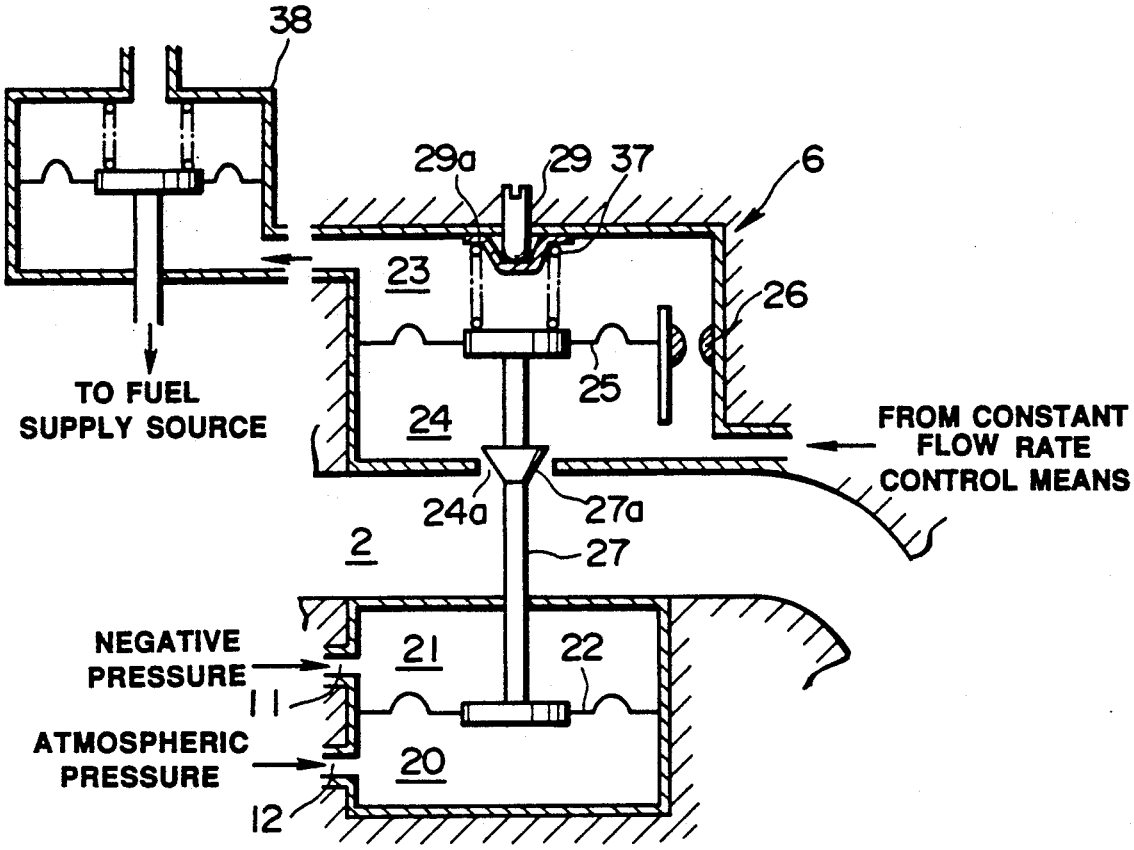
FIG. 10 is a sectional view showing concrete structure of the fuel ejection control means used in a fourth embodiment.
Figure 11:
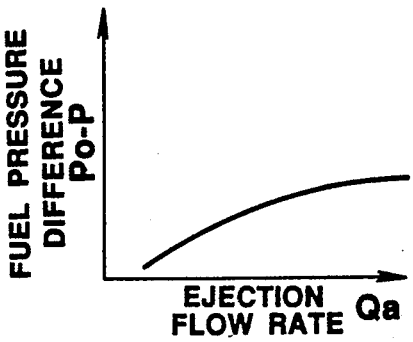
FIG. 11 is a characteristic diagram showing a fuel ejection flow rate and a fuel pressure difference in the fourth embodiment.
Figure 12A:
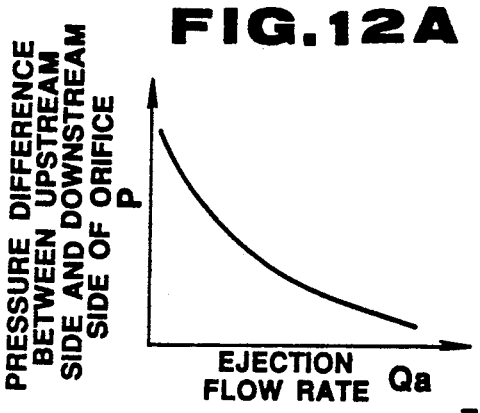
FIG. 12A is a characteristic diagram showing the relationship between a pressure difference between the upstream side and the downstream side of the orifice and a fuel ejection flow rate in the fourth embodiment.
Figure 12B:
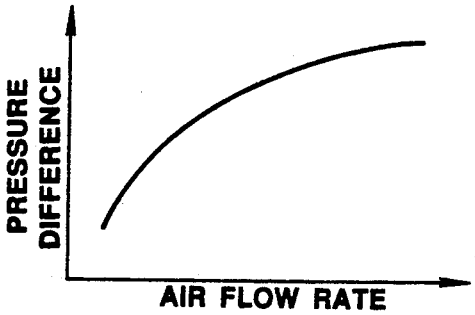
FIG. 12B is a characteristic diagram showing the relationship required between an air flow rate and a pressure difference in the fourth embodiment.

FIG. 10 depicts concrete structure of the fuel ejection control means employed in a fourth embodiment of the present invention. Although this embodiment is different from the embodiment shown in FIG. 5 in that the fuel is fed from the fuel supply source 4 through the constant flow rate control means 3 into the fuel ejection chamber 24 (refer to arrows of broken lines in FIG. 2), that the fuel diaphragm 25 is pressed toward the fuel ejection chamber 24 by a spring 37, and that the fuel flowing from the fuel pressure chamber 23 is returned to the fuel supply source 4 through a regulator fuel section 38, like reference numerals are substantially used to like members and parts with the embodiment of FIG. 5. According to the fuel ejection control means of this type, the relation ship between the ejection flow rate Qa of the fuel and the fuel pressure difference ($P_0-P$) is represented by a characteristic curve deflected somewhat upward as shown in FIG. 11. Also, when the effective area of each of the diaphragms 22, 25 is taken as S, the resilient force of the spring 37 as Fs, and the differential pressure detected by the air flow rate detecting means 1 as Fa, equation (1) described above will be accomplished. FIG. 12A shows the relationship between the fuel pressure difference P between the upstream side and the downstream side of the orifice 26 and the ejection flow rate Qa, and FIG. 12B depicts the relationship between the air flow rate required for the air flow rate detecting means 1 in response to the relationship of P and Qa and the differential pressure to be produced by air thereof. Since the functions of the fourth embodiment are the same as those of the embodiments mentioned already, their explanation will not be required.

Figure 13:
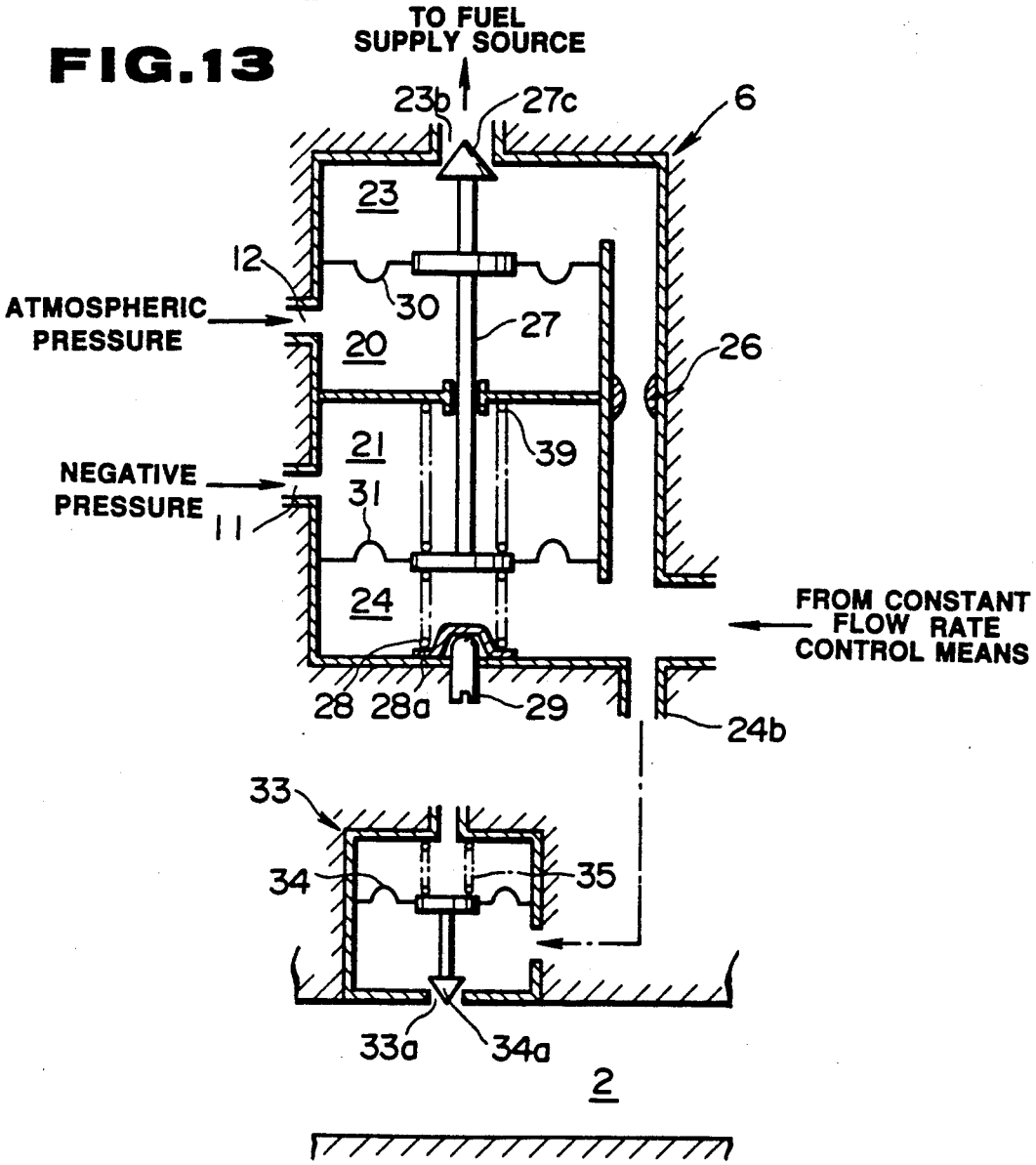
FIGS. 13, 14 and 15 are sectional views showing concrete structure of the fuel ejection control means used in fifth, sixth and seventh embodiments, respectively.

FIG. 13 shows concrete structure of the fuel ejection control means used in a fifth embodiment of the present invention. This embodiment is different from the embodiment shown in FIG. 8 in that the fuel is fed from the fuel supply source 4 through the constant flow rate control means 3 into the fuel ejection chamber 24 (refer to arrows of broken lines in FIG. 2), that the fuel diaphragm 31 is provided, in addition to the spring 28, with a spring 39 opposite thereto, and that the connecting member 27 is provided with a valve 27 adjusting the opening degree of a fuel outlet port 23*b* of the fuel pressure chamber 23 to control a return flow rate of the fuel. In this case, the difference of the resilient force between the springs 28 and 39 corresponds to Fs in equation (1) given above. The fifth embodiment is such that when the second diaphragm 31 is displaced toward the depression chamber 21 in virtue of the differential pressure detected by the air flow rate detecting means 1 and the opening degree of the fuel outlet port 23*b* is reduced by the valve 27*c*, the fuel pressure in the fuel pressure chamber 23 is raised, with the result that the fuel is ejected from the injection nozzle into the suction tube 2 and the pressure difference caused by the air flow rate is counterbalanced with the fuel pressure difference between the upstream side and the downstream side of the orifice 26.

Figure 14:
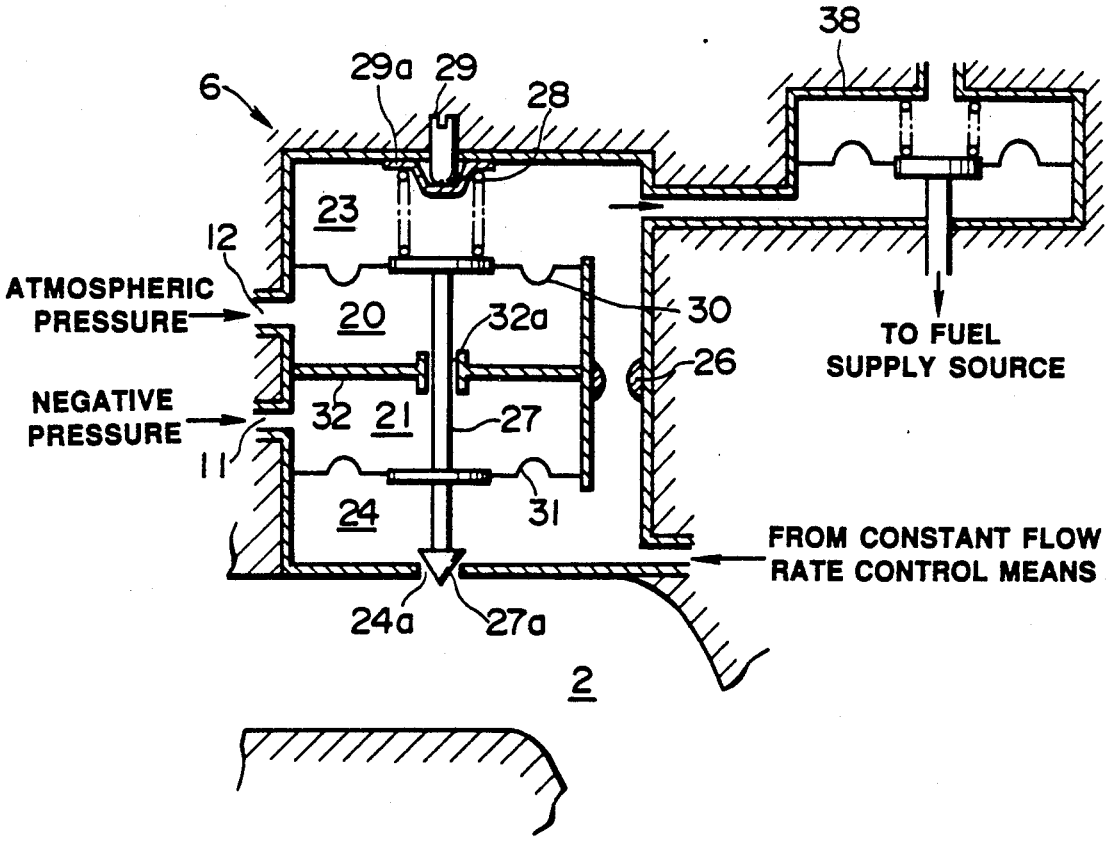

FIG. 14 shows concrete structure of the fuel ejection control means used in a sixth embodiment of the present invention. This fuel ejection control means is different from that shown in FIG. 9 in that the fuel is supplied from the fuel supply source 4 through the constant flow rate control means 3 into the fuel ejection chamber 24 (refer to arrows of broken lines in FIG. 2), that the first diaphragm 30 is pressed only by the spring 28 in the direction in which the fuel ejection valve 27*a* is closed, and that the fuel flowing from the fuel pressure chamber 23 is returned to the fuel supply source 4 through the regulator fuel section 38. Since its functions are the same as those described in reference to FIG. 10, the explanation is omitted.

Figure 15:
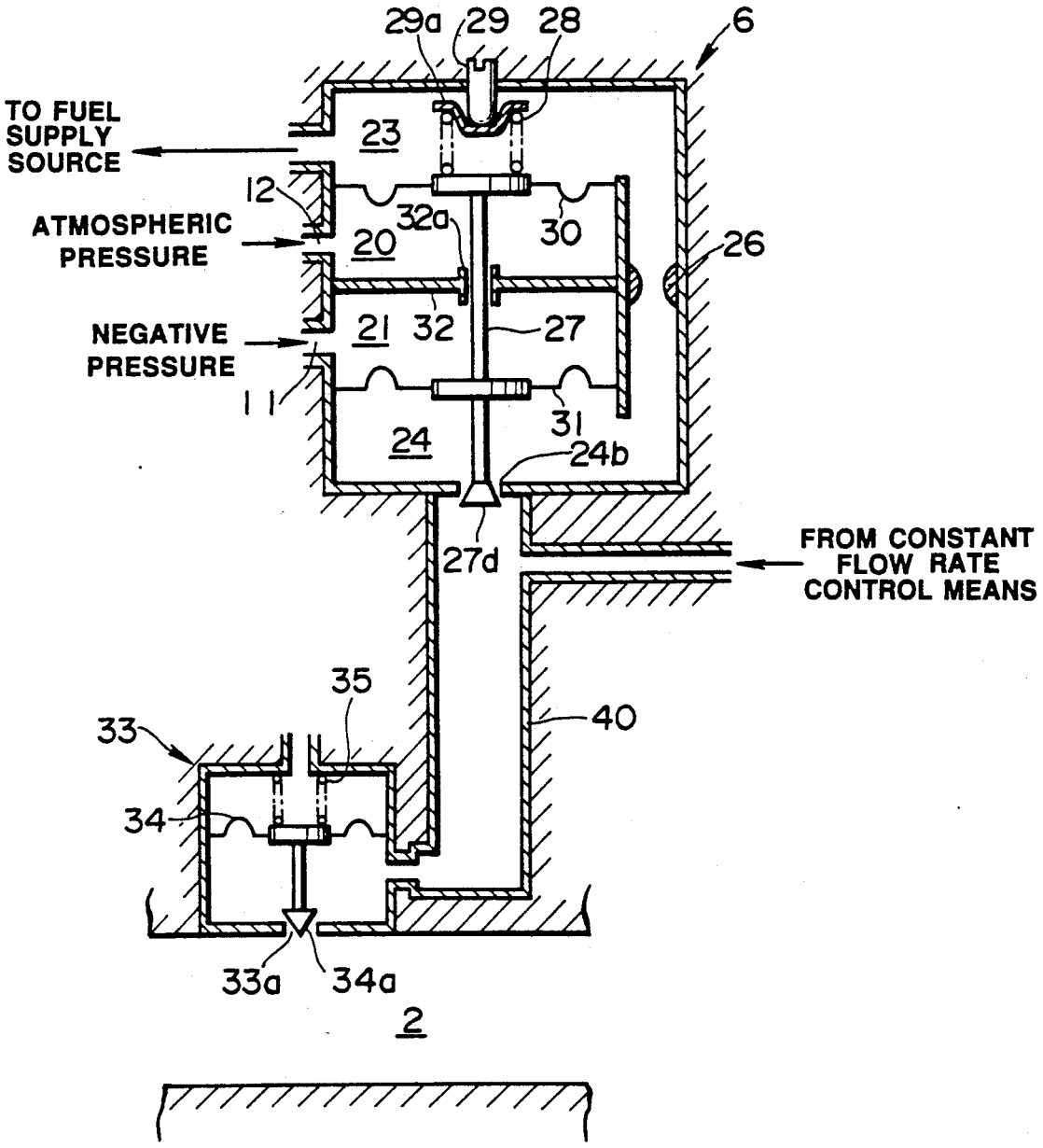

FIG. 15 shows the fuel ejection control means used in a seventh embodiment. This fuel ejection control means 6 is different from that sown in FIG. 14 in that the fuel ejection chamber 24 is provided with the fuel inlet port 24*b*, which is connected to the injection nozzle 33 through a fuel passage 40, that the fuel is supplied from the fuel supply source 4 through the constant flow rate control means 3 into the fuel passage 40 (refer to arrows of broken lines in FIG. 2), that the connecting member 27 is provided with a valve 27*d* capable of controlling the opening degree of the fuel inlet port 24*b*, and that the fuel is directly returned from the fuel pressure chamber 23 to the fuel supply source 4. In this embodiment, when the negative pressure is introduced into the depression chamber 21 from the air flow rate detecting means 1, the valve 27*d* is moved in the direction in which the opening degree of the fuel inlet port 24*b* is diminished until the fuel pressure in the fuel ejection chamber 24 and the fuel pressure chamber 23 decreases. Accordingly, upward pressing force acting on the diaphragm 34 of the injection nozzle 33 increases to open the valve 34*a*. Thus, the fuel is injected into the suction tube 2 and as a result, the fuel pressure difference between the upstream side and the downstream side reduces so that it is counterbalanced with the pressure difference detected by the air flow rate detecting means 1.

In each embodiment described above, a bearing may be used to smooth the movement of the piston valve 7 in the air flow rate detecting means 1.

What is claimed is:

1. A fuel supply system for injection carburetors, comprising:

a first channel including a first orifice and constant flow rate control means for returning only fuel of a predetermined flow rate from the fuel fed from a fuel supply source, to said fuel supply source through said first orifice and said constant flow rate control means;

a second channel branching off from said first channel between said first orifice and said constant flow rate control means, capable of injecting the fuel passing through said first orifice into a suction tube;

air flow rate detecting means associated with and arranged in said suction tube, capable of detecting a flow rate of air sucked into said suction tube as a pressure difference; and fuel ejection control means including said first orifice and said second channel, connected to said air flow rate detecting means for metering a flow rate of fuel to be ejected so that the pressure difference detected by said air flow rate detecting means is balanced with a fuel pressure difference between the upstream side and the downstream side of said first orifice to maintain consistently an air-fuel ratio of a gas mixture to be produced in said suction tube, said constant flow rate control means comprising a diaphragm dividing a fuel inlet chamber from a fuel outlet chamber, a valve connected with said diaphragm to be capable of opening and closing an inlet port of said fuel inlet chamber, a second orifice communicating said fuel inlet chamber with said fuel outlet chamber, and a spring pressing said diaphragm in a direction in which said valve is opened.

2. A fuel supply system for injection carburetors, comprising:

a first channel including a first orifice and constant flow rate control means for returning only fuel of a predetermined flow rate from the fuel fed from a fuel supply source, to said fuel supply source through said first orifice and said constant flow rate control means;

a second channel branching off from said first channel between said first orifice and said constant flow rate control means, capable of injecting the fuel passing through said first orifice into a suction tube;

air flow rate detecting means associated with and arranged in said suction tube, capable of detecting a flow rate of air sucked into said suction tube as a pressure difference; and fuel ejection control means including said first orifice and said second channel, connected to said air flow rate detecting means for metering a flow rate of fuel to be ejected so that the pressure difference detected by said air flow rate detecting means is balanced with a fuel pressure difference between the upstream side and the downstream side of said first orifice to maintain consistently an air-fuel ratio of a gas mixture to be produced in said suction tube, said air flow detecting means comprising a piston valve advancing into or retracting from said suction tube in accordance with the flow rate of air sucked into said suction tube, a spring pressing said piston valve in a direction in which said piston valve advances into said suction tube, a negative pressure passage opened in an internal wall of said suction tube which is directed to an end face of said piston valve, and an air passage opened in an air horn.

3. A fuel supply system for injection carburetors, comprising:

a first channel including a first orifice and constant flow rate control means for returning only fuel of a predetermined flow rate from the fuel fed from a fuel supply source, to said fuel supply source through said first orifice and said constant flow rate control means;

a second channel branching off from said first channel between said first orifice and said constant flow rate control means, capable of injecting the fuel passing through said first orifice into a suction tube;

air flow rate detecting means associated with and arranged in said suction tube, capable of detecting a flow rate of air sucked into said suction tube as a pressure difference; and fuel ejection control means including said first orifice and said second channel, connected to said air flow rate detecting means for metering a flow rate of fuel to be ejected so that the pressure difference detected by said air flow rate detecting means is balanced with a fuel pressure difference between the upstream side and the downstream side of said first orifice to maintain consistently an air-fuel ratio of a gas mixture to be produced in said suction tube, said fuel ejection control means comprising a fuel diaphragm dividing a fuel pressure chamber having a fuel inlet port from a fuel ejection chamber having a fuel ejection port, a negative pressure diaphragm dividing a depression chamber from an atmosphere chamber, a connecting member connected between said fuel diaphragm and said negative pressure diaphragm, having a fuel ejection valve capable of opening and closing said fuel ejection port, and a spring pressing said fuel ejection valve in a direction in which said fuel ejection valve is opened, and said fuel ejection valve is associated with said fuel ejection port so that fuel of the flow rate according to the pressure difference with atmospheric pressure which is detected by said air flow rate detecting means is ejected from said fuel ejection port.

4. A fuel supply system for injection carburetors, comprising:

a first channel including a first orifice and constant flow rate control means for returning only fuel of a predetermined flow rate from the fuel fed from a fuel supply source, to said fuel supply source through said first orifice and said constant flow rate control means;

a second channel branching off from said first channel between said first orifice and said constant flow rate control means, capable of injecting the fuel passing through said first orifice into a suction tube;

air flow rate detecting means associated with and arranged in said suction tube, capable of detecting a flow rate of air sucked into said suction tube as a pressure difference; and fuel ejection control means including said first orifice and said second channel, connected to said air flow rate detecting means for metering a flow rate of fuel to be ejected so that the pressure difference detected by said air flow rate detecting means is balanced with a fuel pressure difference between the upstream side and the downstream side of said first orifice to maintain consistently an air-fuel ratio of a gas mixture to be produced in said suction tube, said fuel ejection control means comprising a first diaphragm dividing a fuel pressure chamber having a fuel inlet port from an atmosphere chamber, a second diaphragm dividing a fuel ejection chamber having a fuel ejection port from a depression chamber, a connecting member connected between said first diaphragm and said second diaphragm, having a valve associated with said fuel inlet port, a spring pressing said valve in a direction in which said valve is opened, and a fuel ejection nozzle connected to said fuel ejection port, ejecting the fuel into said suction tube, and said valve controls the flow rate of the fuel to be supplied to said fuel pressure chamber in accordance with the pressure difference with atmospheric pressure which is detected by said air flow rate detecting means.

5. A fuel supply system for injection carburetors, comprising:

a first channel including a first orifice and constant flow rate control means for returning only fuel of a predetermined flow rate from the fuel fed from a fuel supply source, to said fuel supply source through said first orifice and said constant flow rate control means;

a second channel branching off from said first channel between said first orifice and said constant flow rate control means, capable of injecting the fuel passing through said first orifice into a suction tube;

air flow rate detecting means associated with and arranged in said suction tube, capable of detecting a flow rate of air sucked into said suction tube as a pressure difference; and fuel ejection control means including said first orifice and said second channel, connected to said air flow rate detecting means for metering a flow rate of fuel to be ejected so that the pressure difference detected by said air flow rate detecting means is balanced with a fuel pressure difference between the upstream side and the downstream side of said first orifice to maintain consistently an air-fuel ratio of a gas mixture to be produced in said suction tube, said fuel ejection control means comprising a first diaphragm dividing a fuel pressure chamber having a fuel inlet port from an atmosphere chamber, a second diaphragm dividing a fuel ejection chamber having a fuel ejection port from a depression chamber, a connecting member connected between said first diaphragm and said second diaphragm, having a fuel ejection valve capable of opening and closing said fuel ejection port, and a spring pressing said fuel ejection valve in a direction in which said fuel ejection valve is closed, and said fuel ejection valve being associated with said fuel ejection port so that fuel of the flow rate according to the pressure difference with atmospheric pressure which is detected by said air flow rate detecting means is ejected from said fuel ejection port.

6. A fuel supply system according to any one of claims 1, 2 or 3, wherein means for adjusting resilient force of said spring is provided.

* * * * *